US007787783B2

(12) United States Patent
Aono et al.

(10) Patent No.: US 7,787,783 B2
(45) Date of Patent: Aug. 31, 2010

(54) IMAGE FORMING APPARATUS WITH TEMPERATURE CONTROL

(75) Inventors: Tohru Aono, Mishima (JP); Hidenori Kobayashi, Sunto-gun (JP); Hiroshi Nakayama, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 614 days.

(21) Appl. No.: 11/734,607

(22) Filed: Apr. 12, 2007

(65) Prior Publication Data

US 2007/0242959 A1 Oct. 18, 2007

(30) Foreign Application Priority Data

Apr. 12, 2006 (JP) ..... 2006-109530

(51) Int. Cl.
*G03G 15/00* (2006.01)

(52) U.S. Cl. ..... 399/13; 399/67; 399/69

(58) Field of Classification Search ..... 399/9, 399/13, 67, 69, 122, 320, 328; 219/216
See application file for complete search history.

(56) References Cited

U.S. PATENT DOCUMENTS 6,483,995 B2 * 11/2002 Iwaki et al. ..... 399/12
6,757,502 B2 * 6/2004 Yoshikawa ..... 399/22
7,218,874 B2 * 5/2007 Tomiyori et al. ..... 399/68
2005/0226645 A1 10/2005 Sone et al.
2006/0024071 A1 2/2006 Takami

FOREIGN PATENT DOCUMENTS

JP 07-325500 12/1995
JP 2005-115045 4/2005

OTHER PUBLICATIONS

Chinese Office Action dated Aug. 8, 2008 for Chinese application serial No. 2007100958631.

* cited by examiner

*Primary Examiner*—Hoan Tran
(74) *Attorney, Agent, or Firm*—Turocy & Watson, LLP

(57) ABSTRACT

An image forming apparatus with an image forming section which forms an toner image on a transported sheet; a fixing section which includes a heat source and fixes the toner image on the sheet; a coupling unit which electrically couples the image forming apparatus main unit and the fixing equipment to each other; and a circuit which detects the temperatures of various portions of the fixing equipment, controls the energization condition to the heat source depending on the temperature detection results and stops the energization of the heat source if a temperature beyond a predetermined temperature range is detected by either the first or second temperature detection element, if the coupling unit is disconnected, or if the second temperature detection element is broken.

17 Claims, 4 Drawing Sheets

IMAGE FORMING APPARATUS WITH TEMPERATURE CONTROL

CROSS-REFERENCE TO RELATED APPLICATIONS

This application is based upon and claims the benefit of priority from prior Japanese Patent Application No. 2006-109530, filed on April 12, the entire contents of which are incorporated herein by reference.

BACKGROUND OF THE INVENTION

1. Field of the Invention

The present invention relates to an image forming apparatus in MFPs (Multi-Function Peripherals) as digital composite machines, copiers and printers, and particularly, to an image forming machine which suppresses an increase in temperature.

2. Description of the Related Art

Generally, in an image forming apparatus in MFPs, copiers and printers, there is used a fixing equipment to form a toner image on paper and to fix this toner image on paper. The fixing equipment has a heat roller for heating and a pressure roller, and an unfixed sheet is transported between this pair of rollers.

In such a fixing equipment, in order to prevent an abnormal increase in surface temperature of the heat roller, the temperature of the heat roller is detected by arranging a temperature detection element such as a thermistor and is controlled to be maintained within a predetermined temperature range based on this detection result.

In Jpn. Pat. Appln. Laid-Open Publication No. 7-325500, there is disclosed a fixing equipment which has a heat roller and a pressure roller, a plurality of halogen lamp heaters being provided in the heat roller. In this example, the plurality of halogen lamp heaters are rotatably provided in the heat roller, and in a standby mode where the heat roller is stopped, the plurality of halogen lamp heaters are rotated to maintain the surface temperature of the heat roller equal. In addition, a plurality of thermistors to detect the temperature are arranged on the heat roller and the heating conditions of the halogen lamps are controlled based on the temperature detection results by those thermistors.

However, in the conventional image forming apparatuses and in the example of the above Jpn. Pat. Appln. Laid-Open Publication, there is a problem that the temperature cannot be detected accurately and the fixing equipment is abnormally heated if the element to detect the temperature of the fixing equipment is broken or if the connector to connect the temperature detection element to a control circuit is disconnected.

The present invention may provide an image forming apparatus which controls the temperature of the fixing equipment to prevent the abnormal heating of the fixing equipment and to improve the safety thereof.

DETAILED DESCRIPTION OF THE INVENTION

Figure 1:
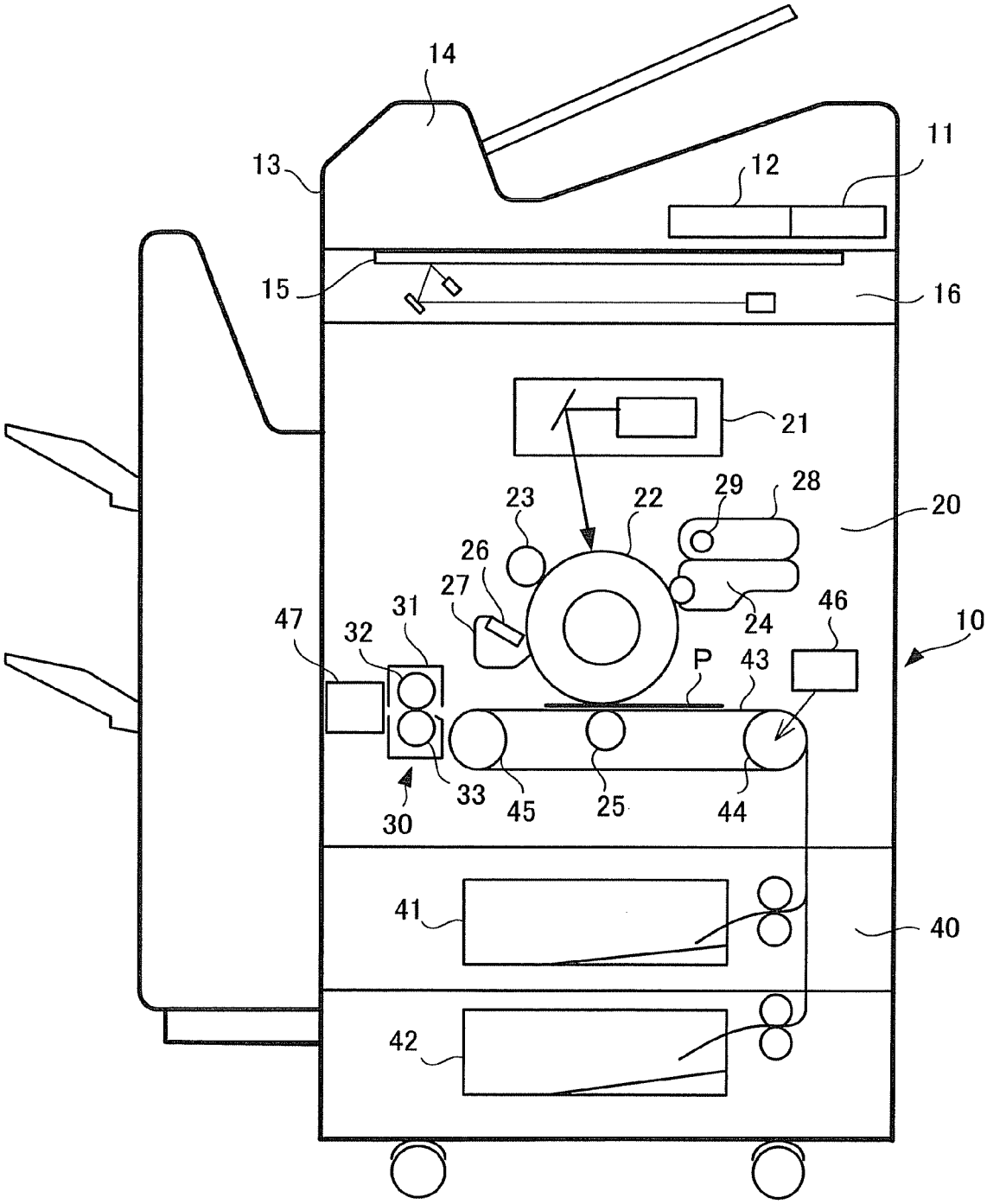
FIG. 1 is a configuration view showing the entire structure of an image forming apparatus of one embodiment of the present invention.

Throughout this description, the embodiments and examples shown should be considered as exemplars, rather than limitations on the apparatus of the present invention.

Now, one embodiment of the present invention will be described in detail with reference to the accompanying drawings. In addition, like reference characters denote like parts in the various views.

FIG. 1 is a configuration view showing the entire structure of an image forming apparatus of one embodiment of the present invention. In addition, in the following description, a MFP as a compound machine will be described as an example, however, the description may be applied also to other image forming apparatuses such as a printer, a copier and the like.

In FIG. 1, a reference numeral 10 denotes an image forming apparatus. The image forming apparatus 10 has a printer section 20 as an image forming section in the center portion thereof. Further, the image forming apparatus 10 has an operating section 11, a display section 12 and a scanner section 13 in the upper portion thereof. The scanner section 13 includes an automatic document feeder (ADF) 14, a transparent original plate 15 and an optical system 16. Further, the image forming apparatus 10 has a paper-feed section 40 in the lower portion thereof.

The printer section 20 composes an image forming section or an image forming means and is, for example, an electrophotographic laser printer. The printer section 20 is provided with an exposure equipment 21 to scan a photoconductor drum 22 by illuminating the photoconductor drum 22 with a laser beam from the exposure equipment 21.

Around the photoconductor drum 22, there are arranged a charger 23, a developing equipment 24, a transfer equipment 25, a cleaner 26 and a toner collection section 27. Toner is supplied to the developing equipment 24 from a toner cartridge 28, and a screw 29 to replenish toner is provided in the toner cartridge 28. In addition, in case of a color laser printer, there are provided developing units of black, cyan, magenta and yellow.

The photoconductor drum 22 is equally charged by the charger 23 on the surface thereof, and by illuminating the photoconductor drum 22 with a laser beam from the exposure equipment 21, an electrostatic latent image is formed. The electrostatic latent image is developed by the developing equipment 24 to form a toner image on the photoconductor drum 22.

Moreover, the paper-feed section 40 is provided with a plurality of paper-feed cassettes 41 and 42 which store sheets of various sizes. Moreover, a sheet P from the paper-feed cassette 41 or 42 is fed to the transfer equipment 25 by a transport belt 43. The transport belt 43 transports the sheet P by moving cyclically by the rotations of rollers 44 and 45. Further, a transport motor 46 is provided to drive the rollers 44 and 45.

The toner image formed on the photoconductor drum 22 is transferred onto the sheet P by the transfer equipment 25, and the sheet P is further transported to the fixing equipment 30 by the transport belt 43. The fixing equipment 30 composes a fixing means for fixing the toner image onto the sheet P and includes a fixing unit 31 as well as a heat roller 32 for heating and a pressure roller 33 provided in the unit 31.

The heat roller 32 is a fixing member and the pressure roller 33 is a pressure member. Toner is fixed onto the sheet P by the heat roller 32 and the pressure roller 33. Moreover, the sheet P passed through the fixing equipment 30 is ejected via a paper ejection section 47. When a finisher is provided in the subsequent stage of the image forming apparatus 10, the sheet P is ejected after stapling or punching has been performed by the finisher.

Figure 2:
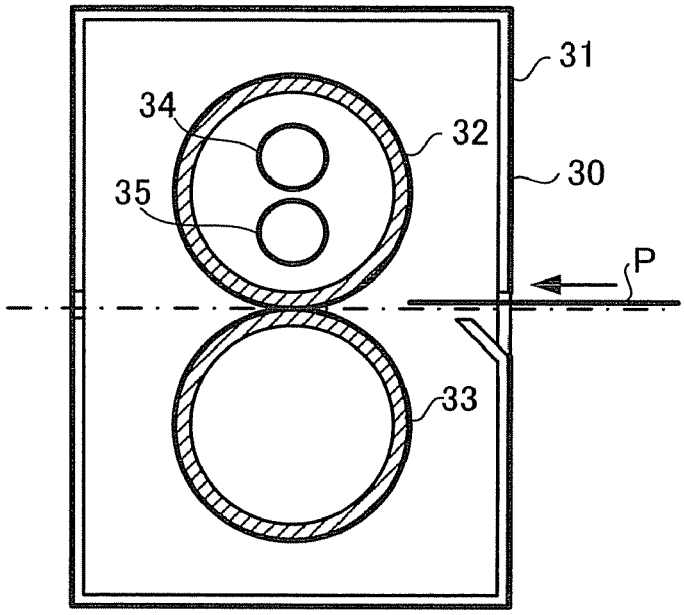
FIG. 2 is a configuration view showing a schematic configuration of a fixing equipment used in the image forming apparatus of one embodiment of the present invention.

FIG. 2 is a schematic view showing a configuration of the fixing equipment 30. The fixing equipment 30 has a fixing unit 31 as well as a heat roller 32 for heating and a pressure roller 33 provided in the unit. The heat roller 32 and the pressure roller 33 have a cylindrical shape respectively, and the pressure roller 33 is brought into contact with the heat roller 32 to pinch the sheet P therebetween and transport it. The heat roller has halogen lamps 34 and 35 as heat sources therein.

Figure 3:
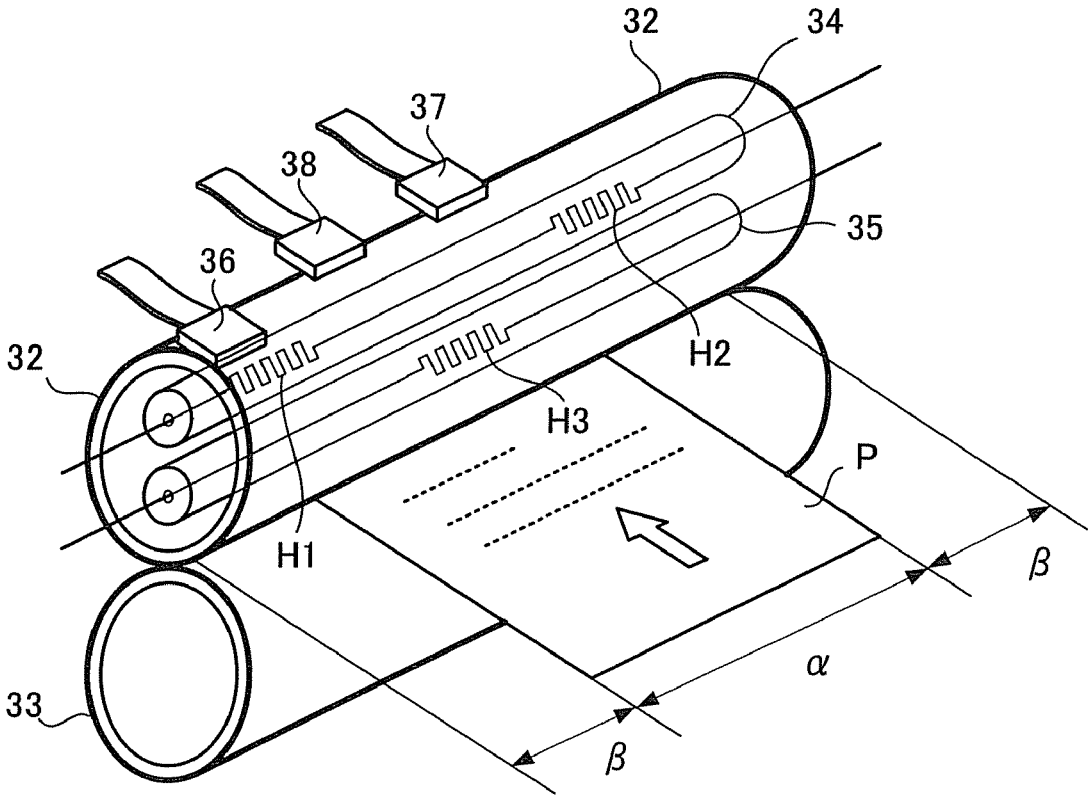
FIG. 3 is a perspective view showing an illustrative example of the fixing equipment used in the image forming apparatus of one embodiment of the present invention.

FIG. 3 is a view illustrating a configuration of the heat roller 32 and the pressure roller 33. Halogen lamps 34 and 35 are provided in the heat roller 32, and the halogen lamp 34 is provided with heaters H1 and H2 in the vicinity of both ends of the heat roller 32 to heat both sides (both ends in an axial direction) of the heat roller 32. The halogen lamp 35 is provided with a heater H3 in the center portion of the heat roller 32 to heat the center portion of the heat roller 32.

The heaters H1 and H2 are connected in series to each other, and current is applied to this series circuit to heat the halogen lamp 34. Similarly, current is applied to the heater H3 to heat the halogen lamp 35.

Moreover, temperature detection elements 36, 37 and 38 are arranged on the heat roller 32. The temperature detection element 36 is, for example, a thermistor and is attached to one end portion (edge portion) of the heat roller 32 with being in contact therewith. Moreover, the temperature detection elements 37 and 38 are, for example, thermopiles (infrared temperature sensors) respectively and are attached to the heat roller 32 with being in non-contact therewith. The temperature detection element 37 is arranged in the center portion of the heat roller 32 and the temperature detection element 38 is arranged in the intermediate portion between the temperature detection elements 36 and 37. These temperature detection elements 36, 37 and 38 detect the temperature from the end portion to the center portion of the heat roller 32 (fixing equipment 30). The temperature detection elements 36, 37 and 38 compose a temperature detection means.

The halogen lamps 34 and 35 in the heat roller 32 are affected more on the terminal end side of the heat roller 32 and less in the center portion thereof by ambient air. Therefore, three temperature detection elements 36, 37 and 38 are provided to accurately detect the temperature of the heat roller 32 at the various sections thereof.

Since the temperature detection elements 37 and 38 are located within a paper-passing range α, non-contact type temperature detection elements are used as the temperature detection elements 37 and 38. If contact type temperature detection elements are used as the temperature detection elements 37 and 38, the heat roller 32 is damaged by contact, resulting in producing seams on a sheet which cause poor fixing. Since the temperature detection element 36 is located outside the paper-passing range β, a contact type element is used.

Figure 4:
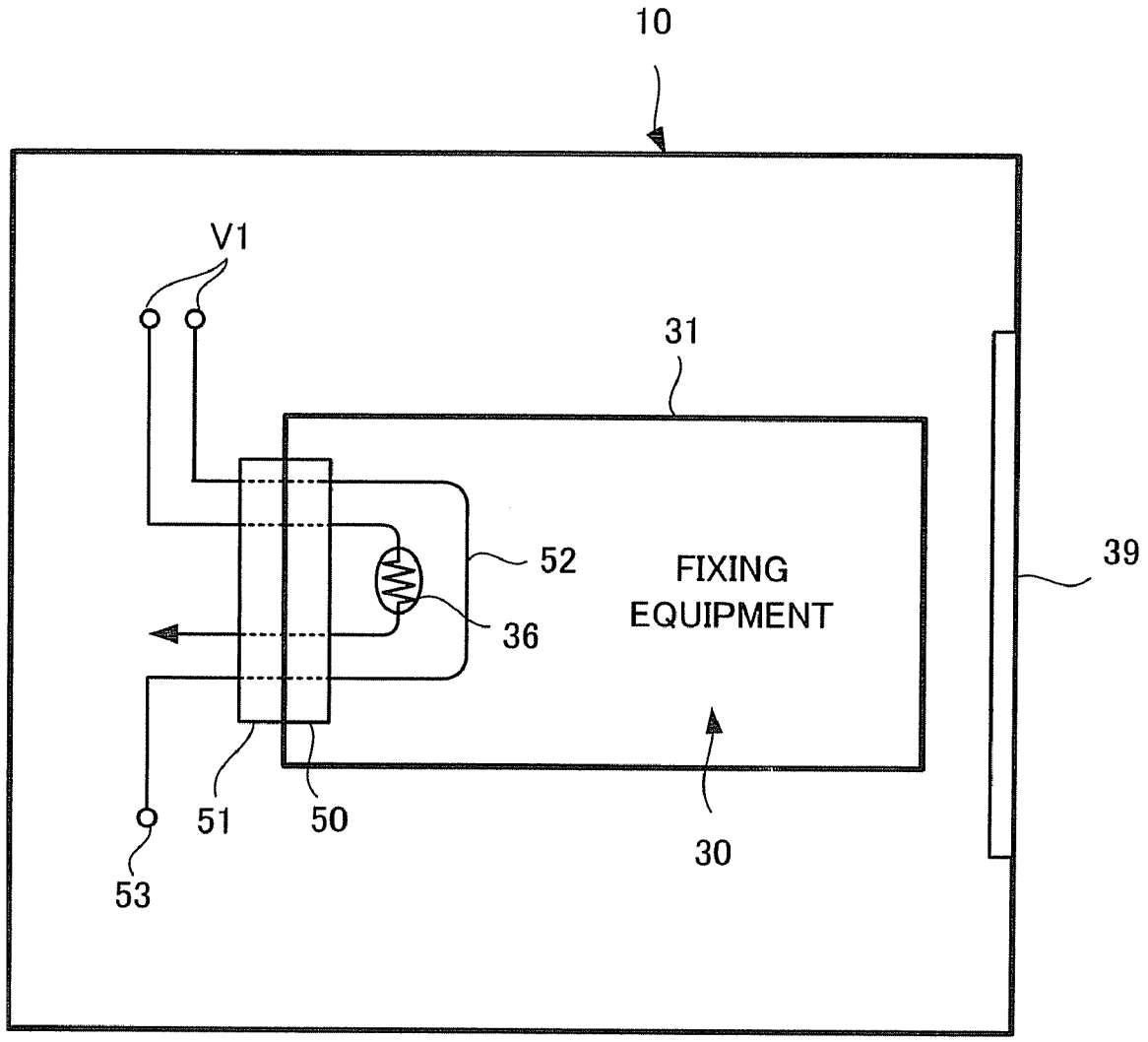
FIG. 4 is a schematic configuration view showing a relationship between an image forming apparatus main unit and the fixing equipment of one embodiment of the present invention.

FIG. 4 is a view schematically showing a relationship between the fixing equipment 30 and the image forming apparatus 10. In the following description, the image forming apparatus 10 is referred to as a main unit 10.

For the fixing equipment 30, the unit 31 is replaceable as a whole and is detachably mounted in the main unit 10 by opening a cover 39. When the unit 31 is mounted in the main unit 10, the fixing equipment 30 and the main unit 10 are electrically connected to each other by connectors 50 and 51 to supply various power supply voltages from the main unit 10 to the fixing equipment 30 and to transmit various detection results from the fixing equipment 30 to the main unit 10. Moreover, the temperature detection element 36 is connected to a power source V1 via the connectors 50 and 51. The connectors 50 and 51 compose a coupling unit or a coupling means.

Moreover, a loop harness 52 is provided between the terminals at both ends of the connector 50, and when the connectors 50 and 51 are connected to each other, voltage from the power source V1 is supplied via the loop harness 52 to a terminal 53. If the connectors 50 and 51 are incompletely connected to each other due to half insertion, the electric circuit from the loop harness 52 to the terminal 53 is broken, and no voltage is obtained at the terminal 53.

Accordingly, when the connectors 50 and 51 are not connected to each other, the output of the temperature detection element 36 cannot be obtained. Moreover, since no voltage is obtained at the terminal 53, the connection condition of the connectors 50 and 51 can be monitored by measuring the voltage of the terminal 53.

The fixing equipment 30 is configured as described above, and now, a configuration of a control system in the present embodiment will be described with reference to FIG. 5.

The control system controls the temperature of the fixing equipment 30 and further detects whether or not the temperature detection element 36 is connected and whether or not the temperature detection elements 37 and 38 are broken. In addition, in FIG. 5 there is shown an example where a thermistor is used as the temperature detection element 36 and thermopiles are used as the temperature detection elements 37 and 38. Therefore, in the following description, the terms: a thermistor 36; and thermopiles 37 and 38 will be used. Moreover, the heater H3 is referred to as a center heater and the heaters H1 and H2 are referred to as side heaters respectively.

Figure 5:
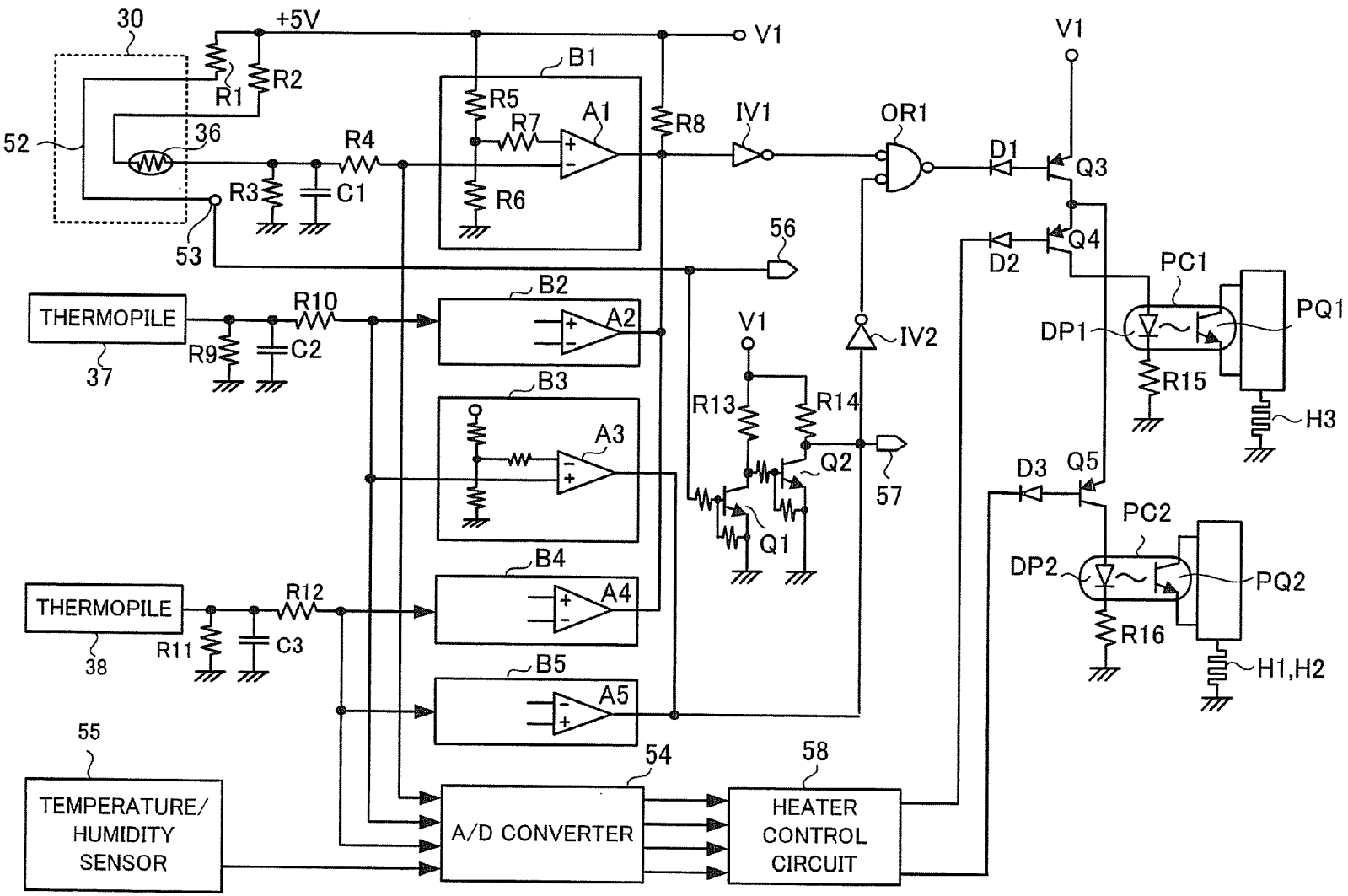
FIG. 5 is a block diagram showing a control system of the image forming apparatus of one embodiment of the present invention.

In FIG. 5, a reference numeral 52 denotes a harness provided in the connector 50. When the connectors 50 and 51 are connected to each other, voltage from the power source V1 (for example, +5V) is supplied via a resistor R1 and the loop harness 52 to the terminal 53, and voltage form the power source V1 is supplied via a resistor R2 to one end of the therminstor 36.

The other end of the thermistor 36 is connected to a ground (reference potential point) via a parallel circuit of a resistor R3 and a capacitor C1 and is further connected to the inverting terminal (−) of a comparator A1 via a resistor R4. Voltage obtained by dividing the voltage of the power source V1 by resistors R5 and R6 is supplied via a resistor R7 to the non-inverting terminal (+) of the comparator A1. The output end of the comparator A1 is connected to the power source V1 via a resistor R8. The comparator A1 is of an open collector output type.

The comparator A1 composes a comparison circuit B1 with the resistors R5, R6 and R7 and compares the voltage at the output end of the thermistor 36 and the reference voltage divided by the resistors R5 and R6 to each other. Since the resistance value of the thermistor 36 varies depending on the temperature, the voltage at the output end thereof (both end voltage between the resistor R3 and the capacitor c1) also varies depending on the temperature.

On the other hand, the output end of the thermopile 37 is connected to the ground via a parallel circuit of a resistor R9 and a capacitor C2. Moreover, the output end of the thermopile 38 is connected to the ground via a parallel circuit of a resistor R11 and a capacitor C3.

Moreover, the output end of the thermopile 37 is connected to a comparison circuit B2 via a resistor R10. The comparison circuit B2 has a comparator A2 and is composed of a similar circuit as in the comparison circuit B1.

Further, the output end of the thermopile 37 is connected to a comparison circuit B3 via a resistor R10. The comparison circuit B3 has a comparator A3. Voltage from the output end of the thermopile 37 is supplied to the non-inverting terminal (+) of the comparator A3 and reference voltage is supplied to the inverting terminal (−) thereof. In this respect, the input form of the comparator A3 is the reversal of the input form of the comparator A1.

Moreover, the output end of the thermopile 38 is connected to a comparison circuit B4 via a resistor R12. The comparison circuit B4 has a comparator A4 and is composed of a similar circuit as in the comparison circuits B1 and B2. Moreover, the output end of the thermopile 38 is connected to a comparison circuit B5 via the resistor R12. The comparison circuit B5 is composed of a similar circuit as in the comparison circuits B3. In addition, the comparison circuits B1 to B5 compose a comparative means.

The output end of the thermistor 36 and the output ends of the thermopiles 37 and 38 are supplied to an analog/digital converter 54 (hereinafter, referred to as A/D converter 54). Moreover, a temperature/humidity sensor 55 is provided to detect the ambient temperature and the humidity of the fixing equipment 30. The detection result by the temperature/humidity sensor 55 is also supplied to the A/D converter 54.

In addition, the resistors R4, R10 and R12 are used to suppress static electricity and the capacitors C1, C2 and C3 are used to prevent voltage drop due to incoming current to the input of the A/D converter 54, and therefore, these resistors and capacitors may be omitted. Moreover, the capacitors C1, C2 and C3 may be arranged on the subsequent stage side of the resistors R4, R10 and R12.

The output ends of the comparison circuits B1, B2 and B4 are connected wired-OR to each other, and the connection point thereof is connected to a first input end of an OR circuit OR1 via an inverter IV1.

The output ends of these comparison circuits B1, B2 and B4 detect an overheated condition of the fixing equipment 30 based on the temperature detection results by the thermistor 36 and the thermopiles 37 and 38. The comparison circuits B1, B2 and B4 compose a first circuit means.

Moreover, the output end 53 of the harness 52 is connected to a base of a transistor Q1. The collector of the transistor Q1 is connected to a base of a transistor Q2. The collector of the transistor Q2 is connected wired-Or to the output ends of the comparison circuits B3 and B5, and the connection point thereof is connected to a second input end of the OR circuit OR1 via an inverter IV2. In addition, the OR-circuit OR1 composes a logical addition means.

The collectors of the transistors Q1 and Q2 are connected to the power source V1 via resistors R13 and R14. The emitters of the transistors Q1 and Q2 are connected to the grounds respectively. The comparison circuits B3 and B5 compose a second circuit means for detecting whether or not the thermopiles 37 and 38 are broken.

The output end 53 of the harness 52 is connected to an output terminal 56. The collector of the transistor Q2 and the output ends of the comparison circuits B3 and B5 are connected to an output terminal 57.

At the output terminal 56 there can be obtained output to detect the condition of the connection between the fixing equipment 30 and the main unit 10. Moreover, at the output terminal 57, there can be obtained output to detect the condition of the breaking of the thermistor 36 and the thermopiles 37 and 38. It is determined depending on the condition of output at the output terminals 56 and 57 if the thermistor 36 is broken or the thermopiles 37 and 38 are broken.

The output end of the OR circuit OR1 is connected to a cathode of a diode D1, and the anode of the diode D1 is connected to a base of a transistor Q3. The emitter of the transistor Q3 is connected to the power source V1.

The collector of the transistor Q3 is connected to a photodiode PD1 of a photocoupler PC1 via an emitter-collector current path of a transistor Q4. Similarly, the collector of the transistor Q3 is connected to an anode of a photodiode PD2 of a photocoupler PC2 via an emitter-collector current path of a transistor Q5.

The cathodes of the photodiodes PD1 and PD2 are respectively connected to the grounds via resistors R15 and R16. The phototransistor PQ1 of the photocoupler PC1 is connected to the center heater H3, and the phototransistor PQ2 of the photocoupler PC2 is connected to the series circuit of the side heaters H1 and H2.

Moreover, the output of the A/D converter 54 is supplied to a heater control circuit 58. The heater control circuit 58 controls the base voltages of the transistors Q4 and Q5 respectively to control the current passing through the photocouplers PC1 and PC2 and to control how the current is carried in the center heater H3 and the side heaters H1 and H2. Accordingly, the heater control circuit 58 composes a temperature control means of the heat roller 32.

Now, the operation of the control system in FIG. 5 will be described. First, the temperature control of the fixing equipment 30 using the temperature detection results by the thermistor 36 and the thermopiles 37 and 38 will be described.

In a case where the connectors 50 (FIG. 4) are connected and the thermistor 36 is normally connected, when the temperature of the fixing equipment 30 is within a normal range, the thermistor 36 has a larger resistance value. Thus, the voltage at the output end of the thermistor 36 becomes lower than the reference voltage of the comparator A1 determined by a voltage division ratio of the resistors R5 and R6, and the output of the comparator A1 becomes a high level "H". The base potential of the transistor Q1 becomes also a high level "H" thereby to turn the transistor Q1 on, and the base potential of the transistor Q2 becomes a low level "L" thereby to turn the transistor Q2 off.

On the other hand, when the thermopiles 37 and 38 are not broken and the temperature of the fixing element 30 is within a normal range, the voltages at the output ends of the thermopiles 37 and 38 are lower than the reference voltages of the comparators A2 and A4 and higher than the reference voltages of the comparators A3 and A5. Thus, the outputs of the comparators A2 and A4 become a high level "H" respectively. As a result thereof, the wired-OR output of the comparators A1, A2 and A4, that is, the input of the inverter IV1 becomes "H" and the output of the inverter IV1 becomes a low level "L".

Moreover, the wired-OR output of the comparators A3 and A5 and the collector of the transistor Q2, that is, the input of the inverter IV2 becomes "H" and the output of the inverter IV2 becomes also a low level "L".

Thus, the output of the OR circuit OR1 becomes "L" thereby to turn the diode D1 and the transistor Q2 on. Since the transistor Q3 is a current supply source for the transistors Q4 and Q5, the transistors Q4 and Q5 are now in an operable state.

On the other hand, the voltages at the output end of the thermistor 36 and at the output ends of the thermopiles 37 and 38 are supplied also to the A/D converter 54, enabling the temperature variations to be detected depending on the output conditions of the A/D converter 54. The heater control circuit 58 composes a control means for creating a temperature control signal in response to the temperature variations caused by the thermopiles 37 and 38 to control the conductivity of the transistors Q4 and Q5 by controlling the base voltages of the transistors Q4 and Q5.

For example, when the temperature of the fixing equipment 30 is low, the transistors Q4 and Q5 become conductive and supply current to the phototransistors PQ1 and PQ2 of the photocouplers PC1 and PC2, performing control to raise the temperature by energizing the center heater H3 and the side heaters H1 and H2. Adversely, when the temperature of the fixing equipment 30 becomes higher, the transistors Q4 and Q5 become non-conductive and no current is supplied to the photocouplers PC1 and PC2, performing control to lower the temperature by stopping energization of the center heater H3 and the side heaters H1 and H2.

Since the fixing equipment 30 detects the temperature of the center portion thereof by the thermopile 37 and the temperature of the end portion by the thermopile 38, the energization conditions of the center heater H3 and the side heaters H1 and H2 are controlled respectively depending on the temperature detection results by the thermopiles 37 and 38.

Moreover, if an increase in temperature beyond the predetermined range is detected at any of the outputs of the thermistor 36 and the thermopiles 37 and 38, the output of any of the comparators A1, A2 and A4 becomes "L". Thus, the output of the inverter IV1 becomes "H" thereby to turn the diode D1 off.

Accordingly, the transistor Q3 as the current supply source is turned off thereby to turn the transistors Q4 and Q5 off, stopping the energization of the center heater H3 and the side heaters H1 and H2 and enabling an abnormal increase in temperature to be prevented. That is, an overheated condition is determined, resulting in forcibly switching the heaters H1, H2 and H3 off.

Then, there will be described a case where the connectors 50 and 51 are connected incorrectly or a case where the thermopiles 37 and 38 are broken. If the connectors 50 and 51 are connected incorrectly, no voltage is supplied to the output end 53 of the harness 52. Thus, the transistor Q1 is turned off and the transistor Q2 is turned on. As a result thereof, the collector of the transistor Q2 becomes "L" and the output of the inverter IV2 becomes "H".

Therefore, the output of the OR circuit OR1 becomes "H", the diode D1 is turned off and the transistor Q3 as the current supply source is turned off. Moreover, the transistors Q4 and Q5 are also turned off, stopping the energization of the center heater H3 and the side heaters H1 and H2. Moreover, the output terminal 56 becomes "L". Using the information of this output terminal 56, there is displayed on the display section 12 a message indicating that the connection condition of the fixing equipment 30 (connection of the connectors) is incomplete.

Moreover, if the thermopile 37 or 38 is broken, no voltage is obtained at the output ends of the thermopiles 37 and 38. Thus, the outputs of the comparators A3 and A5 become "L" and the output of the inverter IV2 becomes "H". As a result thereof, the output of the OR circuit OR1 becomes "H", the diode D1 is turned off and the transistor Q3 as the current supply source is turned off. Accordingly, also in this case, the energization of the center heater H3 and the side heaters H1 and H2 is stopped.

Moreover, the output terminal 57 also becomes "L". Using the information of this output terminal 57 and the output terminal 56, there is displayed on the display section 12 a message indicating that the thermopile 37 or 38 is broken. The display section 12 composes a message display means.

Moreover, the temperature/humidity sensor 55 detects the temperature in the main unit 10 outside the fixing equipment 30. If there is a large difference between the temperature detected by the temperature/humidity sensor 55 and the temperature of the fixing equipment 30, a certain abnormality is determined. Thus, the heater control circuit 58 controls the transistors Q4 and Q5 so as to stop the energization of the heaters H3, H1 and H2.

For example, there is usually no large difference between the temperature detection results by the thermopiles 37 and 38 and the temperature detection result by the temperature/humidity sensor 55. However, if the thermopile 37 or 38 is broken, there is a large difference between the detection results, enabling a breaking to be determined. Moreover, if there is any abnormality in the detection result of humidity by the temperature/humidity sensor 55, control can be performed so as to stop the energization of the heaters H3, H1 and H2.

Accordingly, the temperature/humidity sensor 55, the heater control circuit 58, and the transistors Q3, Q4 and Q5 compose an energization stopping means for stopping the energization of the center heater H3 and the side heaters H1 and H2 in case of an abnormality.

As described above, in the present embodiment, the temperature of the fixing equipment 30 can be controlled so as to be automatically maintained within a predetermined temperature range by detecting the temperature variations of the fixing equipment 30. Moreover, if the temperature has increased abnormally beyond the predetermined range, safety can be improved by stopping the energization of the heaters H1 to H3. Further, it is detected whether or not the connectors 50 and 51 in the unit 31 are connected correctly and whether or not the thermopiles are broken. If the connection is incomplete or either thermopile is broken, the energization of the heaters H1 to H3 of the fixing equipment 30 can be stopped, thereby enabling safety to be improved. Further, any abnormality can be detected by a simple configuration using a wired-OR circuit.

As described above, according to the image forming apparatus of the present embodiment, an abnormal increase in temperature can be prevented by detecting any broken temperature detection element which detects the temperature of the fixing equipment. Moreover, in a steady state, the temperature of the fixing equipment can be maintained appropriately.

Moreover, in the present embodiment, there is described a case where a heat roller is used as a fixing member and a pressure roller is used as a pressure member, however, a fixing equipment using belts or plate-like members other than rollers may be employed.

In addition, without being limited to the above description, for example, temperature detection elements other than thermistors and thermopiles may be used, and various modifications may be made without departing from the scope of the appended claims.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alternations should therefore be seen as within the scope of the present invention.

What is claimed is:

1. An image forming apparatus comprising:

an image forming section which is provided in the image forming apparatus main unit and forms a toner image on a transported sheet;

a fixing section which has a fixing member including a heat source and a pressure member provided with being opposed to the fixing member and fixes the toner image on the sheet;

a coupling unit which electrically couples the image forming apparatus main unit and the fixing section to each other and can detect the mounting/dismounting condition of the fixing section, the coupling unit comprises a pair of connectors which couples the image forming apparatus main unit and the fixing equipment to each other, has a loop harness in the connector of the fixing equipment side and enables the mounting/dismounting condition of the fixing equipment to be detected via the loop harness when the pair of connectors is connected;

first and second temperature detection elements which detect the temperatures of various portions of the fixing equipment;

a temperature control circuit which controls the energization condition to the heat source depending on the temperature detection results by the first and second temperature detection elements; and an energization stopping circuit which stops the energization of the heat source if a temperature beyond a predetermined temperature range is detected by either the first or second temperature detection element, if the coupling unit is disconnected, or if the second temperature detection element is broken.

2. The image forming apparatus according to claim 1, wherein the first temperature detection element is supplied with current via the loop harness to detect the temperature of the end portion of the fixing member; and the energization stopping circuit uses the output of the loop harness to stop the energization of the heat source when the disconnected coupling unit is indicated.

3. The image forming apparatus according to claim 1, wherein the temperature control circuit and the energization stopping circuit comprises:

a first circuit which includes a plurality of comparators comparing the temperature detection results by the first and second temperature detection elements to a first reference voltage respectively and connects the outputs of the plurality of comparators wired-OR to one another;

a second circuit which includes a comparator for comparing the temperature detection results by the second temperature detection element to a second reference voltage;

a logical addition circuit to which the outputs from the first and second circuits are inputted respectively;

a first transistor which is turned on or off in response to the outputs of the logical addition circuit;

a control circuit which creates a temperature control signal varied depending on the temperature detection results of the first and second temperature detection elements; and a second transistor which is connected in series to the first transistor and of which conductivity is varied by the temperature control signal to control the energization amount of the heat source.

4. The image forming apparatus according to claim 1, wherein the first temperature detection element detects the temperature in the vicinity of the end portion of the fixing member with being in contact with the end portion of the fixing member, and the second temperature detection element detects the temperature in the vicinity of the center portion of the fixing member with being in non-contact therewith.

5. The image forming apparatus according to claim 1, wherein the first temperature detection element comprises a thermistor which detects the temperature with being in contact with the end portion of the fixing member and the second temperature element comprises a plurality of thermopiles which detect the temperature of the center portion of the fixing member and the temperature between the center portion and the end portion respectively.

6. The image forming apparatus according to claim 1, further comprising:

a third temperature detection element which detects the temperature of the image forming apparatus main unit, wherein the energization stopping circuit stops the energization of the heat source if the difference between the outputs of the detections by the second and third temperature detection elements is beyond a predetermined range.

7. The image forming apparatus according to claim 1, further comprising:

a message display section which displays a message if the energization of the heat source is stopped by the energization stopping circuit.

8. The image forming apparatus according to claim 7, wherein the message display section displays a message if the coupling unit is disconnected or if the second temperature detection element is broken.

9. The image forming apparatus according to claim 1, wherein the heat source of the fixing member comprises a center heater which heats the center portion of the fixing member and side heaters which heat both sides of the fixing member.

10. An image forming apparatus comprising:

image forming means for forming a toner image on a transported sheet which is provided in the image forming apparatus main unit;

fixing means for fixing the toner image on the sheet which has a fixing member including a heat source and a pressure member provided with being opposed to the fixing member;

coupling means for electrically coupling the image forming apparatus main unit and the fixing means to each other, which can detect the mounting/dismounting condition of the fixing means, the coupling means comprises a pair of connectors which couples the image forming apparatus main unit and the fixing means to each other, has a loop harness in the connector of the fixing means side and enables the mounting/dismounting condition of the fixing means to be detected via the loop harness when the pair of connectors is connected;

temperature detection means for detecting the temperatures of various portions of the fixing means by first and second temperature detection elements;

temperature control means for controlling the energization condition to the heat source depending on the temperature detection results by the first and second temperature detection elements; and energization stopping means for stopping the energization of the heat source if a temperature beyond a predetermined temperature range is detected by either the first or second temperature detection element, if the coupling means is disconnected, or if the second temperature detection element is broken.

11. The image forming apparatus according to claim 10, wherein the first temperature detection element is supplied with current via the loop harness to detect the temperature of the end portion of the fixing member; and the energization stopping means uses the output of the loop harness to stop the energization of the heat source when the disconnected coupling means is indicated.

12. The image forming apparatus according to claim 10, wherein the temperature control means comprises:

first circuit means which includes a plurality of comparators comparing the temperature detection results by the first and second temperature detection elements to a first reference voltage respectively for connecting the outputs of the plurality of comparators wired-OR to one another;

second circuit means which includes a comparator comparing the temperature detection results by the second temperature detection element to a second reference voltage;

logical addition means to which the outputs from the first and second circuits are inputted respectively; and a control circuit which creates a temperature control signal varied depending on the temperature detection results of the first and second temperature detection elements, and the energization stopping means comprises:

a first transistor which is turned on or off in response to the outputs of the logical addition circuit; and a second transistor which is connected in series to the first transistor, and the conductivity of the second transistor is varied by the temperature control signal to control the energization amount of the heat source.

13. The image forming apparatus according to claim 10, wherein the first temperature detection element of the temperature detection means detects the temperature in the vicinity of the end portion of the fixing member with being in contact with the end portion of the fixing member, and the second temperature detection element detects the temperature in the vicinity of the center portion of the fixing member with being in non-contact therewith.

14. The image forming apparatus according to claim 10, wherein the energization stopping means includes a third temperature detection element which detects the temperature of the image forming apparatus main unit and stops the energization of the heat source if the difference between the outputs of the detections by the second and third temperature detection elements is beyond a predetermined range.

15. The image forming apparatus according to claim 10, further comprising:

message display means for displaying a message if the energization of the heat source is stopped by the energization stopping means.

16. A method of controlling the image forming apparatus, comprising:

forming a toner image on a transported sheet by an image forming section which is provided in the image forming apparatus main unit;

fixing the toner image on the sheet by fixing section which has a fixing member including a heat source and a pressure member provided with being opposed to the fixing member;

electrically coupling the image forming apparatus main unit and the fixing section to each other by connectors;

detecting the mounting/dismounting condition of the fixing section based on the coupling condition of the connectors;

detecting the temperatures of various portions of the fixing section by a first and a second temperature detection elements;

detecting the temperature of the image forming apparatus main unit by a third temperature detection element;

controlling the energization condition to the heat source depending on the temperature detection results by a first and a second temperature detection elements to control the temperature of the fixing section;

stopping the energization of the heat source if a temperature beyond a predetermined temperature range is detected by either the first or second temperature detection element, if the coupling unit is disconnected, or if the second temperature detection element is broken; and stopping the energization of the heat source if the difference between the outputs of the detections by the second and third temperature detection elements is beyond a predetermined range.

17. The method of controlling the image forming apparatus according to 16, wherein a message is displayed if the energization of the heat source is stopped.

* * * * *